United States Patent [19]

Gwilliam et al.

[11] Patent Number: 4,711,062

[45] Date of Patent: Dec. 8, 1987

[54] OCTET STRUCTURES USING TENSION AND COMPRESSION

[76] Inventors: Tony S. Gwilliam, 151 N. Alvarado, Ojai, Calif. 93023; Russell Ohu, 2400 Beverly Ave., #18, Santa Monica, Calif. 90405

[21] Appl. No.: 943,559

[22] Filed: Dec. 17, 1986

[51] Int. Cl.[4] ..... E04H 12/18

[52] U.S. Cl. ..... 52/646; 52/81; 52/DIG. 10

[58] Field of Search ..... 52/81, 86, 121, 646, 52/DIG. 10, 645

[56] References Cited

U.S. PATENT DOCUMENTS

| | | | |
|---|---|---|---|
| 3,063,521 | 11/1962 | Fuller | 52/646 |
| 3,185,164 | 5/1965 | Pinero | 52/646 X |
| 3,751,863 | 8/1973 | Lyons | 52/121 X |
| 3,771,274 | 11/1973 | Vaughan | 52/646 |
| 4,207,715 | 6/1980 | Kitrick | 52/DIG. 10 |
| 4,371,344 | 2/1983 | Gorczyca | 52/DIG. 10 |
| 4,449,348 | 5/1984 | Jacobs | 52/DIG. 10 |
| 4,557,097 | 12/1985 | Mikulas | 52/646 |
| 4,578,920 | 4/1986 | Bush et al. | 52/645 |
| 4,587,777 | 5/1986 | Vasques et al. | 52/645 X |

*Primary Examiner*—J. Karl Bell

*Attorney, Agent, or Firm*—Poms, Smith, Lande & Rose

[57] ABSTRACT

Octahedral structures using compression and tension members are joined along a common edge to form adjacent tetrahedrals, to produce a rigid or flexible "octet" structural system. Pairs of tension members interconnecting corners of the octahedra may be lengthened and shortened to provide controlled hinging of the adjacent octahedra about the common edge. The octahedra may be collapsed into a linear bundle of struts and tension members or cables by lengthening the tension cables and pivoting the struts into alignment at their junction. Octahedral/tetrahedral structures may extend for many modules in three directions to form an extended structure, with openings provided where desired by omtting one or more octahedra. Special plates for coupling between the ends of the compression members, and the tension members include slots for receiving the tension members and a central opening for securing the compression member to the plate and for locking the tension members to the plates, with the plates forming parallel planes above and below the octahedral structures.

20 Claims, 18 Drawing Figures

Fig. 1.
PRIOR ART
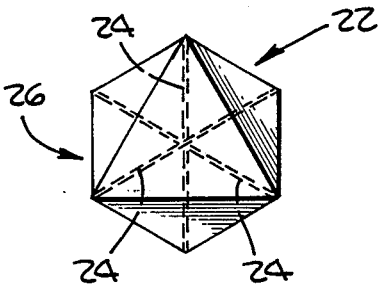
Fig. 2.
PRIOR ART
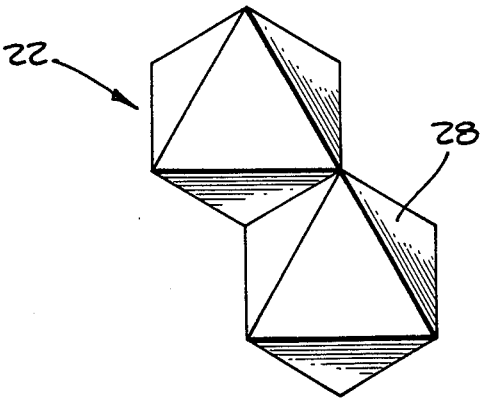
Fig. 3.
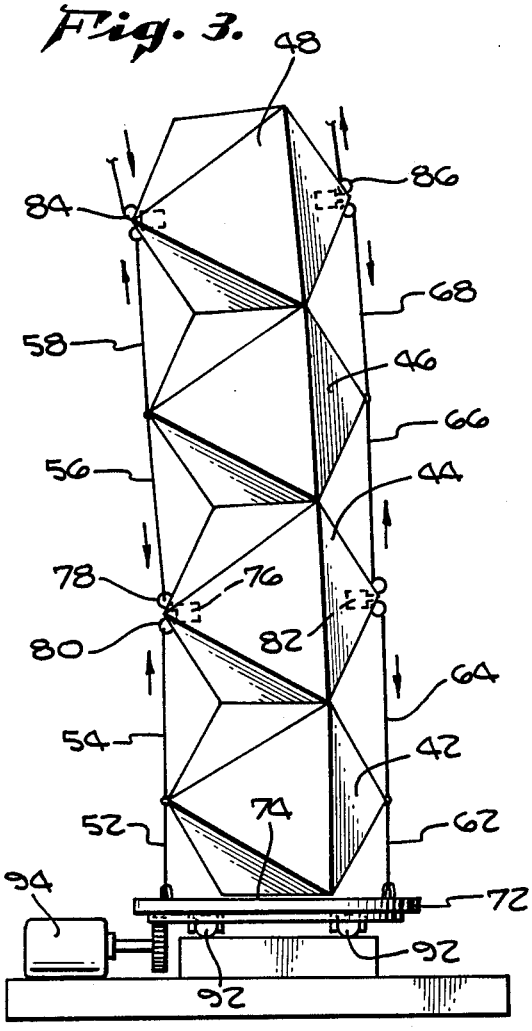
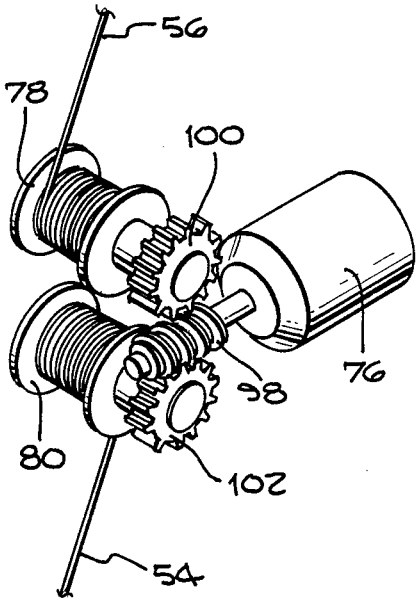
Fig. 4.

OCTET STRUCTURES USING TENSION AND COMPRESSION

Field of the Invention

This invention relates to structures formed of octahedral and tetrahedral cells each including tension and compression members.

BACKGROUND OF THE INVENTION

It has previously been proposed to form structures using octahedral tension/compression cells. C. J. Kitrick U.S. Pat. No. 4,207,715, granted June 17, 1980, and entitled "Tensegrity Module Structure and Method of Interconnecting the Modules", is directed to this type of structure. Other related patents include R. B. Fuller U.S. Pat. No. 3,063,521, granted Nov. 13, 1962 and U.S. Pat. No. 3,354,591, granted Nov. 28, 1967.

To visualize the configuration of the octahedral cells or modules, they may be considered as formed of two pyramids each having four equilateral triangular sides, and with their bases joined together. Each octahedron has eight equilateral triangles for sides, six outwardly extending points, and twelve edges. When one of the octahedral cells rests on a flat surface on one of its equilateral triangular faces, the opposite (top) side is parallel to the bottom side but the upper equilateral triangle is displaced angularly in orientation, with its outwardly extending apeces overlying the sides of the lower triangular sides, and not with the points or apeces overlying one another.

When an octahedral tension/compression cell is formed, three mutually perpendicular equal length struts are secured together at their centers, and their outer ends are joined by tension members such as cables or wires. The resulting structural members have a high strength-to-weight ratio.

In U.S. Pat. No. 4,207,715, structures are built up with the successive octahedra being aligned, and with the compression members therefore being discontinuous. The patent text states that "The compression members in effect float within a sea of tension."

SUMMARY OF THE INVENTION

In accordance with one aspect of the present invention, octahedral cells of the tension/compression type are secured together, edge to edge, and tension members interconnect spaced points of the two adjacent octahedral cells to form tetrahedra; and the resultant series of octahedral and tetrahedral cells, (sometimes referred to herein as "octets"), with compression members linked, are employed to form lightweight structures of high strength.

In one embodiment, adjacent octahedral cells of the tension/compression type are made to pivot about their common edge by lengthening the tetrahedral tension member on one side of the common edge, and shortening the paired tension member on the other side thereof.

To provide movement of the resulting linear structure (mast or arm) in any desired direction, a rotational mount may be provided, and additional octahedral cells added to the structure. Groupings of such curvilinear structures produce curved planes.

In accordance with another aspect of the invention, collapsability of a structure formed of octahedral cells or modules may be provided through the use of a pivoted central coupling for the struts and by the inclusion of arrangements for lengthening or separating the tension members, or shortening of the compression members.

Still another aspect of the invention involves the use of extended planar arrays of octahedral modules, with openings or holes formed in the array by the omission of one or more of the octahedral modules.

In accordance with yet another aspect of the invention, special coupling fittings between the struts or compression members and the tension members at the ends of the compression members may include a central opening to receive the end of the strut or a threaded fastener to hold the strut in place, and several slots radiating out from the hole to receive the tension members, so that they are locked in place as the central hole is secured to the end of the strut. These coupling fittings may be substantially plate-like in configuration and the arrays of octahedral modules may include one set of these plate-like fittings aligned in a plane above the array, and another set in a parallel plane below the array. The fittings may be coupled together to produce multilayer structures. Other fittings that can be used include compression fittings with continuous cable or strapping and adhesive or chemical bonding.

Other objects, features, and advantages of the invention will become apparent from a consideration of the following detailed description and from the accompanying drawings.

Brief Description of the Drawings

FIG. 1 is an octahedral cell or module using compression and tension elements;

FIG. 2 shows two of the modules or cells of FIG. 1 brought close together, with one edge in common;

FIG. 3 shows a structure illustrating the principles of the invention in which a series of octahedral cells are joined to form octahedral/tetrahedral or octet composite structures;

FIG. 4 is an enlarged showing of a component which may be employed in the implementation of the structure of FIG. 3;

Detailed Description

Figure 5:
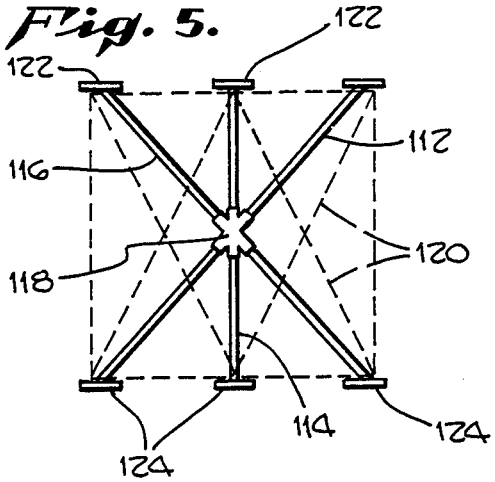
FIG. 5 is a side view of a specific octahedral module.
Figure 6:
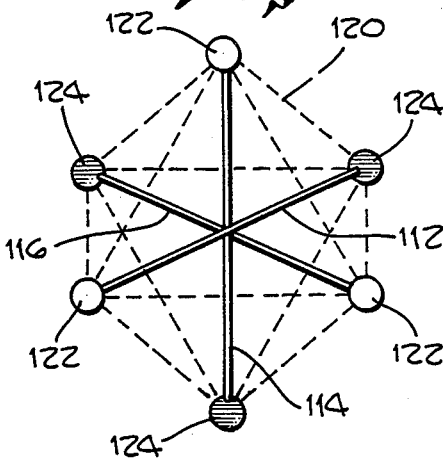
FIG. 6 is a top view of the octahedral module shown in FIG. 5.

Referring more particularly to the drawings, FIG. 1 is a diagrammatic representation of an octahedral tension/compression module 22 having three central mutually orthogonal struts or compression members 24, and 12 tension cables or wires 26 extending along the edges of the octahedron. As mentioned above, FIGS. 1 and 2 as shown herein appear in U.S. Pat. No. 4,207,715, granted June 17, 1980. FIG. 2 shows the first octahedral cell 22, together with a second similar octahedral cell 28 brought up toward the first module 22 so that one of their edges is aligned with a corresponding edge of the other module. U.S. Pat. No. 4,207,715 lists the subject matter of FIGS. 1 and 2 as set forth hereinabove as "prior art", and then proceeds to direct the subject matter of the patent to arrangements wherein no compression members engage or abut against compression members as shown in FIG. 2 set forth hereinabove. More particularly, both in U.S. Pat. No. 4,207,715, and in U.S. Pat. No. 3,063,521, it is apparently considered desirable that "the compression members in effect float within a sea of tension", see column 1, lines 22 and 23 of U.S. Pat. No. 4,207,715. A similar statement appears in U.S. Pat. No. 3,063,521, column 1, lines 26 to 28, in which it is stated that "The compression will be subjugated so that the compression elements become small islands in a sea of tension".

As will be developed in greater detail hereinbelow, however, and in accordance with one aspect of the present invention, it has been determined that octahedral modules generally patterned after those shown in FIGS. 1 and 2, may be advantageously coupled along one edge, and with tension elements interconnecting the nearby corners of the octahedra to form tetrahedral cells or modules between adjacent octahedral cells, and with the compression elements positively abutting one another to provide increased strength and stiffness to the structures, while maintaining the advantages of low weight, characteristic of this type of structure.

FIG. 3 shows a modular structure including a series of octahedral modules 42, 44, 46 and 48. These modules are intercoupled by tension elements or flexible cables 52, 54, 56 and 58 extending up the left-hand side of the structure, and tension elements or cables 62, 64, 66 and 68 extending up the right-hand side of the structure as shown in FIG. 3.

The lowermost tension elements or cables 52 and 62 are of fixed length, and hold the lowermost octahedral module 42 erect and in a fixed position relative to the base 72 to which the lowermost edge 74 of the octahedral module 42 is secured. Now, consideration will be given to the tension members 54 and 64 which interconnect the outwardly extending corners of modules 42 and 44. When these tension members 54 and 64 are of equal length and rigidly connected to the corners of the two modules, the space between the tension member 54 and the two octahedrons 42 and 44 is a regular tetrahedron. Various structures employing tetrahedral and octahedral modules of this type will be discussed in greater detail hereinbelow.

Now, returning to FIG. 3, a motor 76 and a pair of winches 78 and 80, of the type shown in FIG. 4, are mounted at the corner of the octahedron 44, where the tension members 54 and 56 meet. A similar motor and winch assembly 82 is mounted at the opposite corner of the octahedral module 44, with the tension members 64 and 66 being coupled to the associated winches. Similar motor-winch assemblies 84 and 86 are connected to the opposite corners of the octahedral module 48. By actuating the motor 76 and the motor associated with the motor/winch assembly 82 concurrently, the tension members 54 and 56 are shortened and the tension members 64 and 66 are lengthened. The overall structure as shown in FIG. 3 then tilts to the left, as indicated in the drawing. To provide further versatility in the motion of the system, the turntable 72 is mounted on bearings 92 and may be rotated by the motor 94 so that the structure may be angled in any desired direction. With this system, virtually any desired configuration may be established and altered at will. Although the arrangement of FIG. 3 has been shown using a linear array of octahedral members, planar and multilayer arrays of octahedral/tetrahedral modules may be employed, and the entire array curved by shortening and lengthening tension and/or compression members, as desired.

Incidentally, concerning the assembly of FIG. 4, the motor 76 drives a worm-gear 98 which meshes with two spur gears 100 and 102 associated with the winches 78 and 80, respectively, to tighten or loosen the cables or tension members 54 and 56, as desired, by the direction of rotation of the reversible motor 76.

FIGS. 5 through 8 of the drawings will now be considered, and they show a basic octahedral module. More specifically, with reference to FIGS. 5 and 6, the three central compression members 112, 114 and 116 extend to the six apexes or corners of the octahedral module, and cross close to one another, mutually perpendicular to one another at the central fitting 118, the center of the unit. As will be discussed hereinbelow, a rigid central fitting 118 may be provided, or pivoting arrangements may be employed to permit collapsing of the module. Tension elements 120 are shown by dashed lines, and extend to the special coupling fittings or plates 122 and 124 which are mounted at the top and bottom, respectively, of the module, with the outer surfaces of the plates being parallel to one another. For convenience in the understanding of FIG. 6 of the drawings, the upper plate-like coupling members 122 are shown with circles which have light centers and the lower coupling members 124 are darkened.

Figure 7:
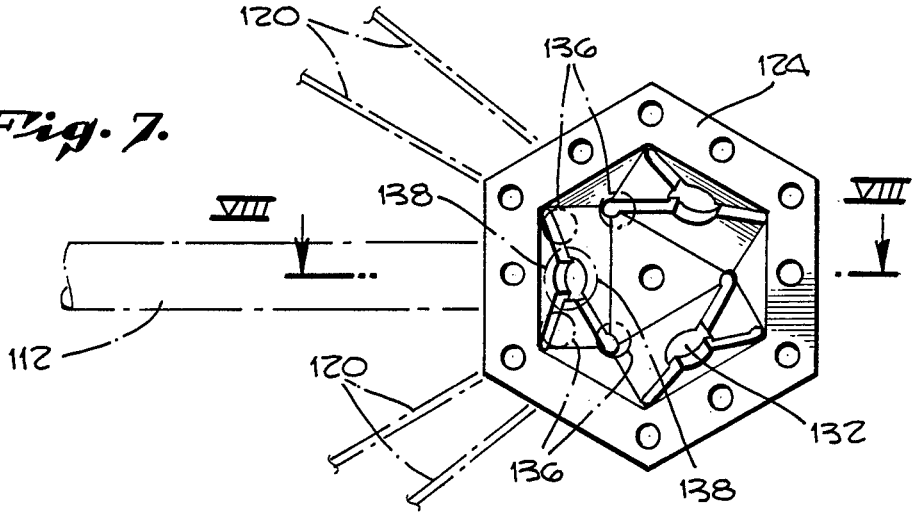
FIG. 7 is a top view of one of the junction points of the apparatus of FIGS. 5 and 6.
Figure 8:
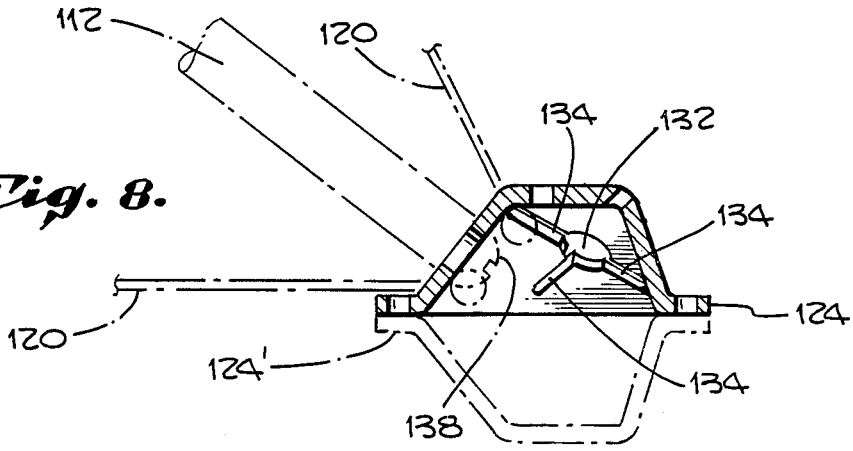
FIG. 8 is a view taken along lines VIII—VIII of FIG. 7, and also shows connectors coupled to produce multilayer structures.

The details of the coupling plates 124 will be developed in connection with FIGS. 7 and 8 of the drawings. As may be observed, the plates 124 are generally hexagonal, and have three broader faces on a frustoconical protrusion from the hexagonal base. Each of the three broader faces includes a central hole 132 and three slots 134. In practice, the tension members 120 have enlarged or knotted ends 136 which fit through the central hole 132 and the tension members may be then slid into one of the slots 134. A threaded fastener is then secured through the central hole 132 either in the form of a screw or a bolt, and this prevents the removal of the tension members. In the case of FIG. 7, the screw 138 is threaded into the end of the compression member 112 and fills the hole 132, thus preventing removal of the tension members. In the event that the structure is not provided with a compression member to enter each of the three main openings on the frustoconical surface of the coupling member 124, a plug may be inserted to lock the tension members in place. The flange around the plates is used to couple plates together for multi-layer situations and to secure strapping when this is preferred to cables.

Figure 10:
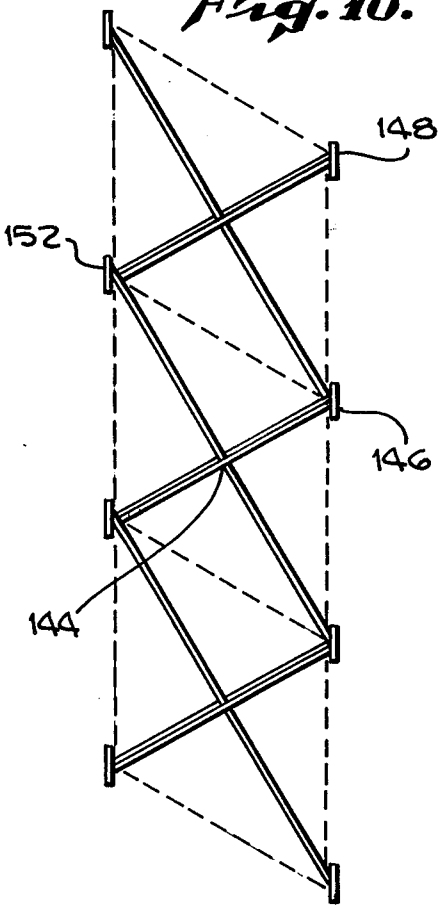
FIG. 10 is a view taken along lines X—X of FIG. 9.
Figure 9:
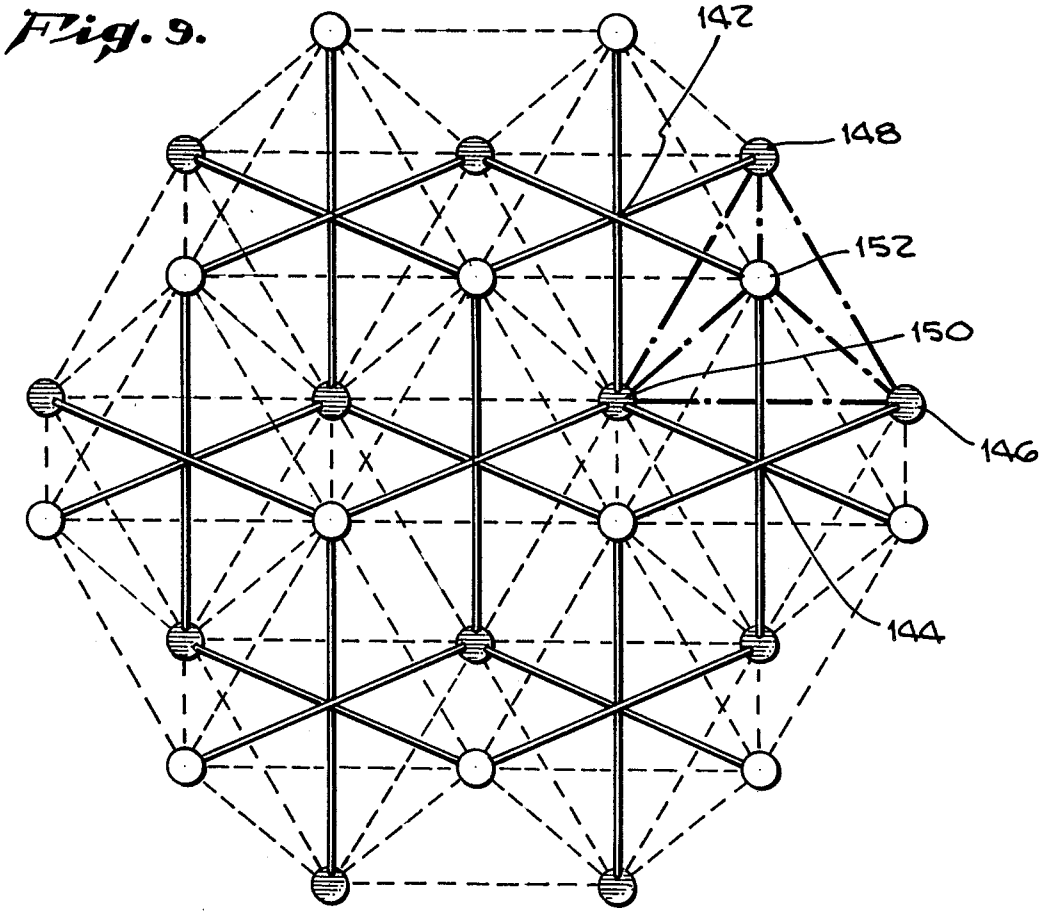
FIG. 9 is a top view of a truss structure made up of a series of octahedral and tetrahedral modules.

FIGS. 9 and 10 show a structure made up of a substantial number of the octahedral modules, with each module being indicated by the point where the three compression members cross. Thus, for example, one of the octahedral modules is centered at 142, and another at point 144. One of the tetrahedral modules is indicated by dashed lines, with special markings on the dashed line, and extending from the three lower plate-like coupling members 146, 148 and 150, to the upper coupling plate 152. Incidentally, in FIG. 9 the upper plates are again shown with circles which are essentially open while the lower plates are shown darkened. From an overall standpoint, FIGS. 9 and 10 indicate the mode of extension of the octahedral/tetrahedral, or "octet" structure to a large planar array which may be extended substantially indefinitely. Other layers can be added above and below the plane.

Figure 11:
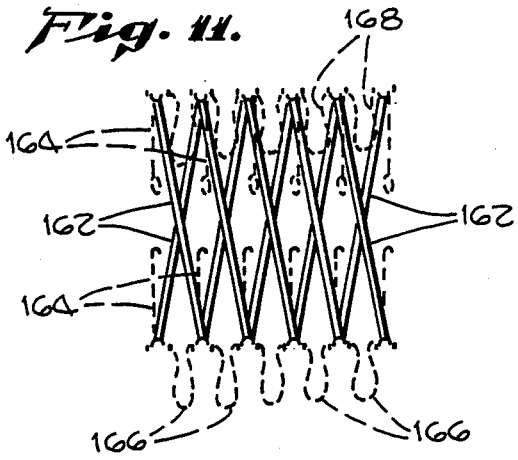
FIG. 11 is a schematic showing of a truss of the type shown in FIGS. 9 and 10 in its collapsed or folded condition.
Figure 13:
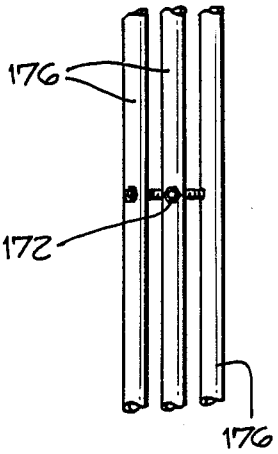
FIG. 13 is a diagrammatic showing of a set of three struts forming the compressional elements of an octahedral cell or module, in their collapsed configuration.

FIG. 11 is a diagrammatic showing of an octet truss being collapsed, with the truss members 162 being folded from their mutually orthogonal erected configuration to a parallel configuration, and with the tension members 164 extending from the top to the bottom of the array being extended or unhooked from one another, while the tension members 166 at the bottom of the array and the tension members 168 at the top of the array being slack. In order to facilitate the collapsing configuration, a junction or joint at the center of each octet may be in the form shown in FIG. 12, with a central member 172 having three outwardly extending fasteners 174 passing through the three compression members 176. FIG. 13 is a view of the three compression members of a single octahedral module with the three compression members 176 being collapsed to their parallel configuration.

Figure 14:
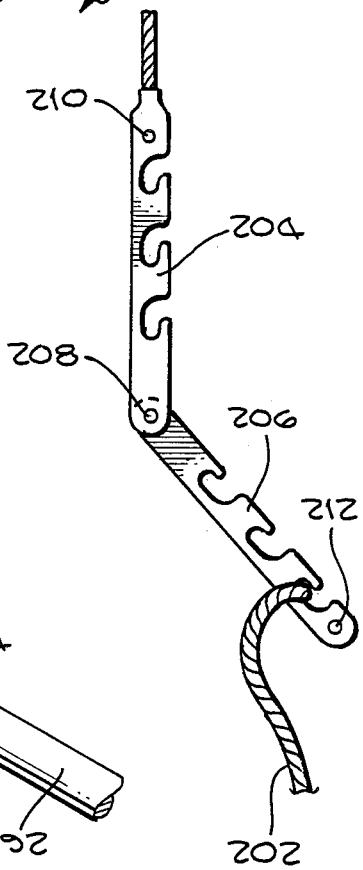
FIG. 14 is a hinged extender member for the tension elements in the collapsing arrangement as shown in FIG. 11, for example.

FIG. 14 shows one technique for lengthening the tension member 202, so that a taut condition may obtain when the two hinged parts 204 and 206 of the extender are pivoted to their closed position about the pivot point 208. Following this shift in position, a pin or bolt may be inserted through the openings 210 and 212 to insure that the extender remains closed when the structure is to be in its upright or erected position. Incidentally, the tension members should be extended to a length slightly greater than the length of the compression members, in order to permit collapsing of the units. In one exemplary relatively small truss configuration, the tension members might be approximately 18 inches in length with the compression members being approximately 26 inches in length when the module is erected. Accordingly, the extender 204, 206, should extend the length of the tension members by slightly more than 8 inches, such as about 10 inches. In FIG. 11, in some cases the vertically extending tension members have been shown as having loops and hooks, and for some purposes suitable loops and hooks would be adequate. However, for greater stability, extender elements which may be locked to their closed position, such as that shown in FIG. 14 are to be preferred. Elements of the type shown in FIG. 14, are commercially available as purchase items. Alternatively, shortening the compression members will enable the structure to fold.

Figure 15:
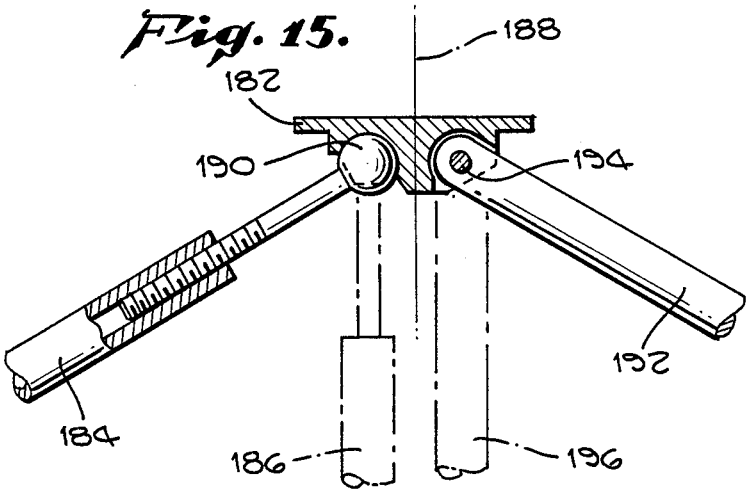
FIG. 15 shows two alternative constructions for providing folding or hinged corner structures for use when two or more compression members are joined to a common point.

FIG. 15 shows two alternative arrangements for the coupling plate 182 to permit shifting of the compression member 184 to its collapsed position 186. To the left of the central line 188, this is accomplished by the ball and socket joint 190 which permits rotation of the compression member 184 to the position indicated at 186. Similarly, to the right of line 188, the compression member 192 is shown pivoting about pin 194 from position 192 to the collapsed configuration position 196.

Figure 12:
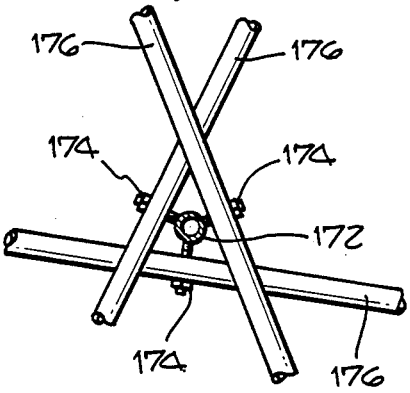
FIG. 12 is a diagrammatic showing of the coupling at the center of the struts for the modular cells, to facilitate collapsing as shown in FIG. 11.
Figure 16:
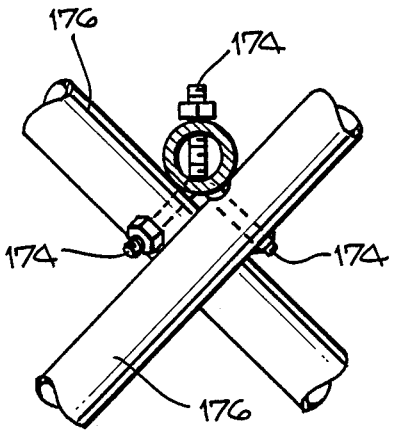
FIG. 16 is a cross-sectional view illustrating a coupling member of the type shown in FIG. 12.

FIG. 16 is a cross-sectional view taken through one of the mutually orthogonal compression members 176 of FIG. 12, and the three mutually orthogonal fasteners 174 are also visible in FIG. 16.

Figure 17:
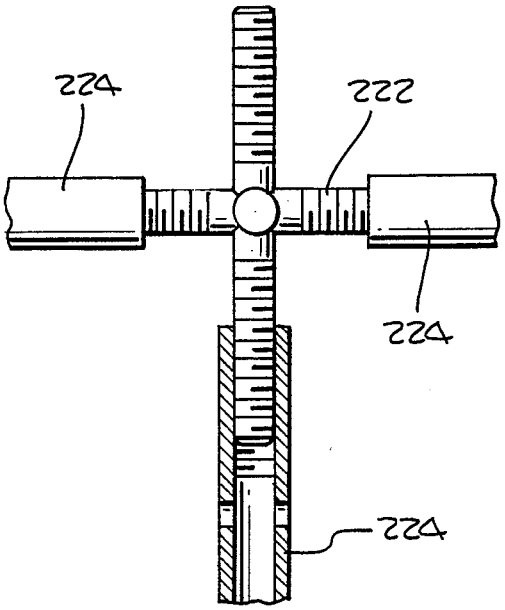
FIG. 17 shows a rigid central joint for octahedral modules which are not intended for collapsing.

FIG. 17 is a top view of a rigid joint which may be employed at the center of the octahedral modules, when collapsing is not appropriate or desired. More specifically, the rigid junction member 222 has six outwardly extending threaded portions 224. Six equal length compression members 224 each having a length substantially equal to one-half that of conventional compression members, may be employed, and are provided with internal threads to secure the compression members to the rigid joint 222.

Figure 18:
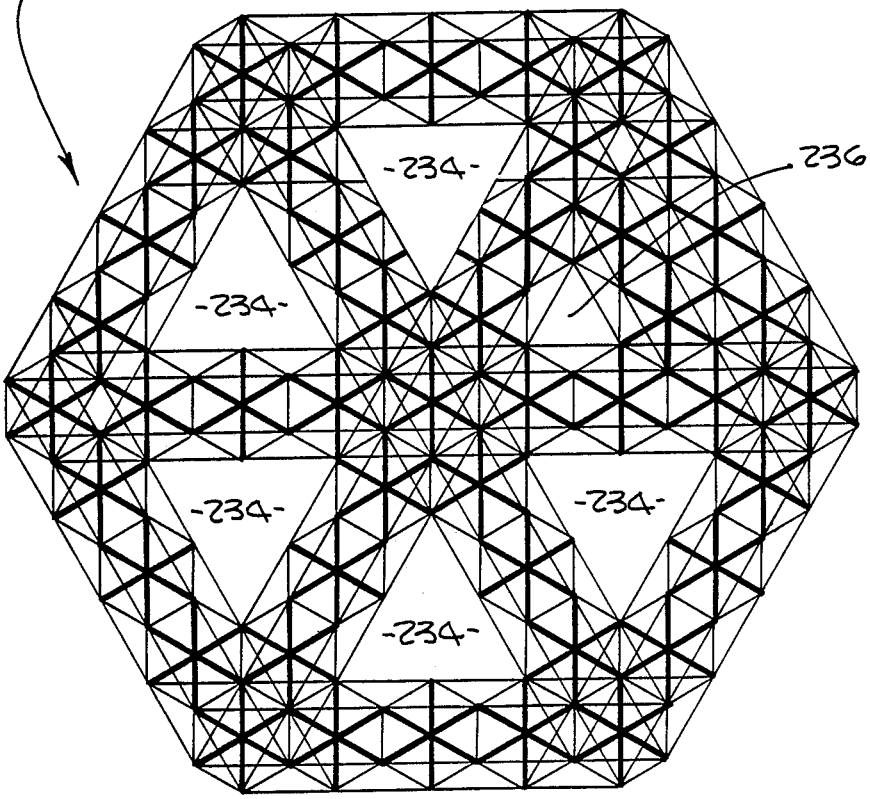
FIG. 18 shows an extended planar array of octahedral/tetrahedral compression/tension modules, with selected modules being omitted to provide openings in the array for any desired purpose.

FIG. 18 is a showing of an extended planar array 232 of octahedral modules. The planar array 232 includes a number of openings 234, each of which involves the omission of three octahedral modules to provide openings for any desired purpose. The remainder of the unit forms a rigid structure. To illustrate the flexibility in the design, the opening 236 only involves the omission of one, rather than three of the octahedral modules. As can be appreciated, when the planar array is continuous, it is more rigid; however, when it is desired to have openings for any particular purpose, or when there is adequate strength and it is desired to reduce the weight of the array, octahedral modules may be omitted, as shown in FIG. 18.

In conclusion, it is to be understood that the foregoing detailed description and the accompanying drawings illustrate the preferred embodiments of the invention. Various mechanical alternatives may be employed instead of those specifically described hereinabove. Thus, by way of example, and not of limitation, instead of hexagonal coupling plates, they could be round or square; or compression fittings with continuous cable or strapping, or adhesive, welded or chemically bonded joints, may be employed. In addition, when desired, an occasional triangular panel may be substituted for a set of three of the tension members forming one of the equilateral triangular sides of one of the octahedral modules, or a square panel may replace two of the compression members. Also, folding and collapsing of the structures may be accomplished by shortening the compression members, thereby releasing tension in the tension elements. Conversely, the structures may be stiffened by lengthening the compression members. Accordingly, it is to be understood that the present invention is not limited to that shown in the drawings and described hereinabove in detail.

What is claimed is:

1. An octet structure having a high strength-to-weight ratio comprising:

a plurality of octahedral modules, each including three compression struts and a plurality of flexible tension members interconnecting the ends of said struts;

means for joining a plurality of said octahedral modules along edges thereof shared in common by at least two of said modules; and means including additional flexible tension members forming tetrahedral cells adjacent said octahedral modules.

2. A structure as defined in claim 1 including means for providing relative pivotal movement of one of said octahedral modules with respect to an adjacent octahedral module by changing the lengths of said additional tension members forming said tetrahedral cells.

3. A structure as defined in claim 1 including means for pivotally mounting said compression members together so that they may be folded from an erected mutually perpendicular orientation to a collapsed parallel configuration, to facilitate compact storage of the structure.

4. A structure as defined in claim 1 wherein coupling means are provided for securing said tension members to said struts, said coupling means including means for locking said tension members to said coupling means as said struts are fastened to said coupling means.

5. A structure as defined in claim 4 wherein said coupling means includes a plurality of holes for receiving fasteners for connection to said struts, and a plurality of slots extending outward from each of said holes.

6. A structure as defined in claim 1 including at least three interconnected octahedral modules.

7. A structure as defined in claim 6 wherein said octahedral modules are coupled together to form a planar array.

8. A structure as defined in claim 7 wherein at least one central octahedral module is omitted from the array to provide an opening in the planar array.

9. A structure as defined in claim 1 including a plurality of plate-like coupling means for interconnecting the ends of said struts and said tension members, said plate-like coupling members being oriented substantially parallel to one-another.

10. A structure as defined in claim 9 wherein said plates are located substantially in two planes, one plane being on one side of the structure, and the other plane being on the other side of the structure.

11. A structure as defined in claim 1 including means for releasing the tension in tension elements interconnecting one side of said structure with the opposite side thereof to permit folding or collapsing of said structure.

12. A tension/compression structure having a high strength-to-weight ratio comprising:

a plurality of octahedral modules, each including three compression struts and a plurality of flexible tension members interconnecting the ends of said struts; and coupling means for securing said tension members to said struts, said coupling means including means for locking said tension members to said coupling means as said struts are fastened to said coupling means.

13. A structure as defined in claim 12 including means for pivotally mounting said compression members together so that they may be folded from an erected mutually perpendicular orientation to a collapsed parallel configuration, to facilitate compact storage of the structure.

14. A structure as defined in claim 12 wherein said coupling means includes a plurality of holes for receiving fasteners for connection to said struts, and a plurality of slots extending outward from each of said holes.

15. A structure as defined in claim 12 wherein said coupling means are plate-like in configuration, and said plate-like coupling members are oriented substantially parallel to one-another.

16. A structure as defined in claim 15 wherein said plates are located substantially in two planes, one plane being on one side of the structure, and the other plane being on the other side of the structure.

17. A tension/compression structure having a high strength-to-weight ratio comprising:

a plurality of octahedral modules, each including three compression struts and a plurality of flexible tension members interconnecting the ends of said struts; and means for releasing the tension in tension elements interconnecting one side of said structure with the opposite side thereof to permit folding or collapsing of said structure.

18. A structure as defined in claim 17 including means for pivotally mounting said compression members together so that they may be folded from an erected mutually perpendicular orientation to a collapsed parallel configuration, to facilitate compact storage of the structure.

19. A structure as defined in claim 17 including a plurality of plate-like coupling means for interconnecting the ends of said struts and said tension members, said plate-like coupling members being oriented substantially parallel to one-another.

20. A structure as defined in claim 17 including coupling members for interconnecting the ends of said struts and said tension members, and including a plurality of struts pivotally connected to at least one of said coupling members, whereby folding or collapsing of said structure is facilitated.

* * * * *

UNITED STATES PATENT AND TRADEMARK OFFICE

CERTIFICATE OF CORRECTION

PATENT NO. : 4,711,062

DATED : December 8, 1987

INVENTOR(S) : Tony S. Gwilliam et al.

It is certified that error appears in the above-identified patent and that said Letters Patent is hereby corrected as shown below:

On the title page, Item [76], "Russell Ohu" should read

-- Russell Chu --.

Signed and Sealed this

Tenth Day of May, 1988

*Attest:*

DONALD J. QUIGG

*Attesting Officer*

*Commissioner of Patents and Trademarks*